United States Patent [19]

Anderson et al.

[11] 4,437,285

[45] Mar. 20, 1984

[54] BUILDING STRUCTURE

[76] Inventors: Inge Anderson; Ronny Johansson, both of Pl. 3322 B, Åskloster, Sweden, 430 21

[21] Appl. No.: 336,358

[22] PCT Filed: Apr. 27, 1981

[86] PCT No.: PCT/SE 81/00127

§ 371 Date: Dec. 22, 1981

§ 102(e) Date: Dec. 22, 1981

[87] PCT Pub. No: WO 81/03194

PCT Pub. Date: Nov. 12, 1981

[30] Foreign Application Priority Data

Apr. 29, 1980 [SE] Sweden ..... 8003222

[51] Int. Cl.[3] ..... A47F 5/00; E04B 2/60

[52] U.S. Cl. ..... 52/481; 52/241; 52/456; 52/731

[58] Field of Search ..... 52/481, 731, 732, 238, 52/275, 282, 475, 479, 772, 779, 780, 781, 729, 241, 455, 456

[56] References Cited

U.S. PATENT DOCUMENTS 3,604,168 9/1971 Meineke ..... 52/481 X
3,757,485 9/1973 Vincens ..... 52/731

FOREIGN PATENT DOCUMENTS 235529 9/1964 Austria ..... 52/481
678486 Italy ..... 52/731
6407024 10/1969 Netherlands ..... 52/731

*Primary Examiner*—John E. Murtagh
*Assistant Examiner*—Richard Chilcot
*Attorney, Agent, or Firm*—Holman & Stern

[57] ABSTRACT

A building structure comprising a plurality of post (1) designed with a mainly H-shaped cross section and arranged to be located in upright position in a chute-formed base portion (3) and panel sections (2) adapted to be fitted to the posts and the base portion. The posts (1) and the base portion are provided with surfaces (7, 13) inclined at an angle of 45°, the panel sections (2) are provided with first flanges (17) bent in a corresponding manner and adapted after the mounting to engage against said inclined surfaces (7, 13) and during mounting when they are bent aside to slide against the inclined surfaces of the post and the base portion in order to locate a locking member (18) provided at the outer end of the flanges to engagement behind said inclined surfaces.

6 Claims, 17 Drawing Figures

BUILDING STRUCTURE

CROSS REFERENCE TO RELATED APPLICATION

The invention of this application is disclosed in corresponding International Application No. PCT/SE81/0027 filed Apr. 27, 1981, the benefit of which is being claimed.

BACKGROUND OF THE INVENTION

1. Field of the Invention

The present invention relates to a building structure of the type incorporating a framework consisting of vertical posts and base portions and head portions adapted to interconnect and keep the posts together and with separate wall sections fitted in the spaces between posts, base portions and head portions.

2. Description of the Prior Art

Building structures of this type are earlier known in a plurality of different embodiments which are more or less complicated in shape and handling. These older structures are often precisely adapted to a specific building purpose which means that they have almost no flexibility in the choice of building side and design.

BRIEF SUMMARY OF THE INVENTION

The present invention has for a purpose to provide a building structure of the type in question, which has a very great flexibility and which is very simple especially to mount and dismount without tools other than a common screw driver and this has been achieved mainly in that each post has an approximately H-shaped cross-section, in which each leg of the H-profile extends obliquely on its outer surface by froming each outer surface inclined obliquely. Each base portion and each head portion at its side turned to the center of the framework in a manner similar to the posts are provided with a groove located between material portions having surfaces inclined obliquely outwards. Flat, smooth wall elements and/or thin-walled panel sections along all edges are provided with flange portions bent in the same direction as the inclined surfaces of the posts, the base portions and the head portions, which flange portions at their outer ends are provided with folded material portions, the smooth wall elements being intended to be mounted with the edge portions engaging in the grooves in the base portions, in the head portions and in the space between the legs, of the the H-profile, whereas the panel sections are intended to be snapped with their flange portion to the inclined surfaces of the framework of the structure, and the folded material portions are adapted to snap into the grooves behind said inclined surfaces in the framework.

DESCRIPTION OF THE DRAWINGS

The invention will hereinafter be further described with reference to the accompanying drawings wherein.

DETAILED DESCRIPTION

Figure 1:
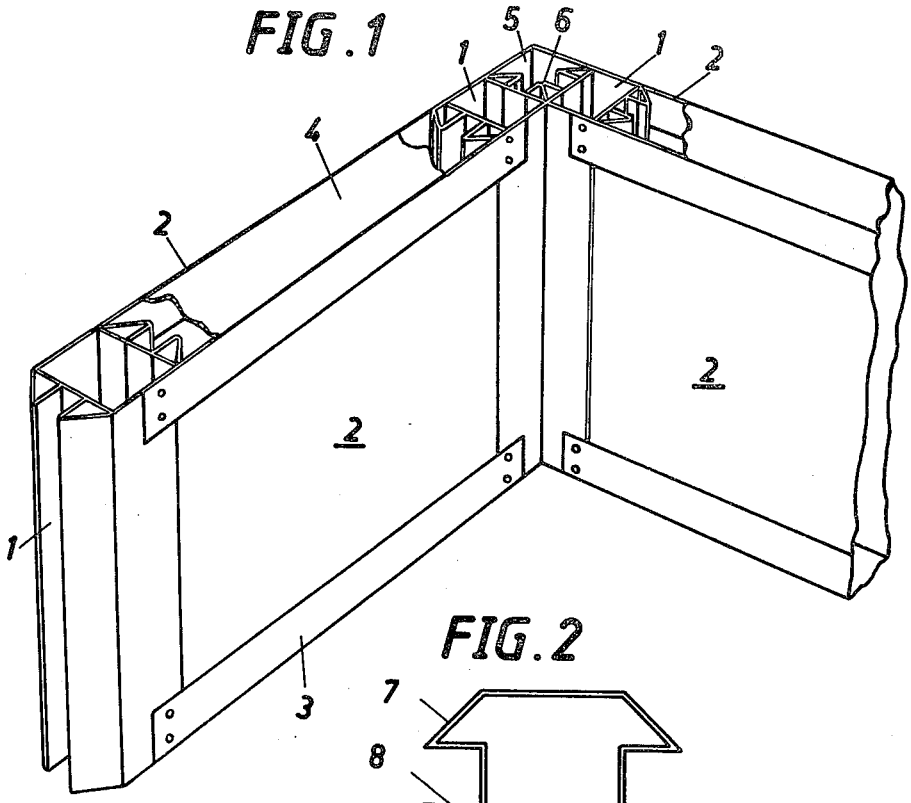
FIG. 1 is a perspective view showing a portion of a building structure according to the invention with certain material portions omitted.

In FIG. 1 is shown in perspective a portion of a wall erected with the building structure according to the invention and as can be seen from this FIGURE the sturcture incorporates a plurality of vertical posts 1 having a mainly H-haped cross-section. The structure furthermore comprises a plurality of panel sections 2 mounted on the posts and a plurality of base portions 3 and head portions 4, which is basically the same component and the shape of which will be further described hereinafter. The structure also incorporates a corner connection 5, 6 intended for forming of wall corners and these components will also be further described hereinafter and are used or forming together with two posts a corner in the stucture. The FIGURE also shows how a wall in a simple manner can be built by means of the building structure according to the invention and for the sake of clarity parts of the head portions 4 have been cut away in the FIGURE.

Figure 2:
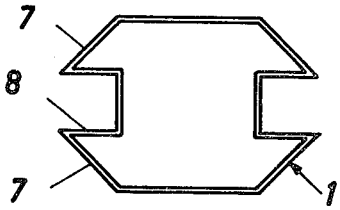
FIG. 2 is a cross-sectional view of a one-piece post forming part of the building structure according to the invention.

In FIG. 2 is shown a cross-section of a post 1, which in this embodiment is made in one piece, e.g. by extrusion or the like. The post 1 has the shape of a H (in the FIGURE shown in laying position), the shanks or legs of which at their ends having inclined surfaces 7 which form and angle of 45° with the longitudinal direction of the legs. Between the inner side o the two legs and the cross bar or web there is thus formed two parallel grooves 8 running in the longitudinal direction of the post and intended together with the inclined surfaces 7 to contribute to the attachment of the panel sections such as will be further described hereinafter.

Figure 3:
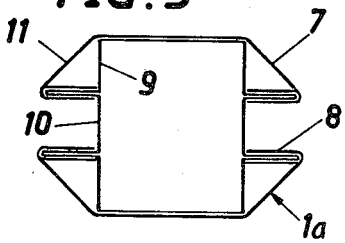
FIG. 3 is a similar view of a post consisting of a number of sheet metal sections.
Figure 4:
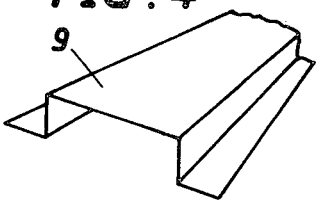
FIGS. 4–6 are perspective views showing the sheet metal profiles forming parts of the post according to FIG. 3, FIGS 7 and 8 are a perspective view and a top plan view respectively of a base portion and a head portion forming part of the building structure according to FIG. 1.
Figure 5:
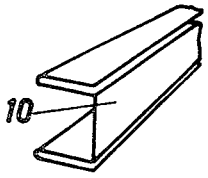
Figure 6:
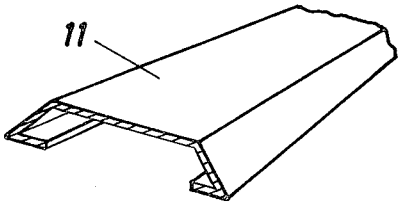

In FIG. 3 is shown an alternative embodiment of a post 1*a*, which is constructed from a number of sheet metal profiles in accordance with FIGS. 4–6, which in perspective show portions of the profiles forming part of the post.

The post 1*a* incorporates two profiles 9 according to FIG. 4, two profiles 10 according to FIG. 5 and two profiles 11 according to FIG. 6. In making this post the two mainly -shaped profiles 9 are located with the open sides against each other, whereupon the [-shaped profiles 10 with their double-flanged ends from the sides are fitted so that the four profiles together form a closed four-sided body having protruding portions-the shanks of the H-profile. The profiles 11 with the folded flange portions are thereupon each pushed from one of the ends of the post over to opposite projecting portions, whereby the profiles 11 will effectively interlock the separate sheet metal profiles to form a post without the need of any other type of attachment means. The profiles 11 are provided with inclined surfaces which form the inclined surfaces 7 of the post. This post 1*a* thereby has a shape quite analogous with the post 1 according to FIG. 2 with inclined surfaces 7 and grooves 8.

Figure 7:
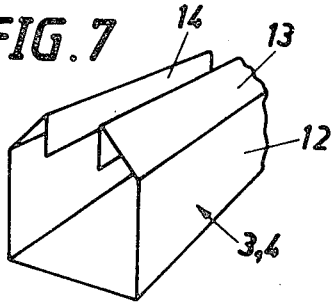
Figure 8:
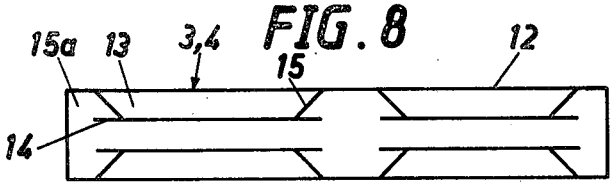

In FIGS. 7 and 8 are shown in a perspective view and in a plan view respectively a base portion 3 and a head portion 4. This base portion or head portion is formed by a mainly U-shaped chute preferably of sheet metal material in which the U-shanks 12 at their free ends have been bent inward/upward at an angle of 45° and these bent portions 13 are in turn at their free ends provided with flange portions 14 which extend in parallel with the U-shanks 12 a short distance towards the interior of the U-profile. In FIG. 8 is shown how the base portion or the head portion at equal mutual distances is provided with recesses 15 in the angular portions 13. These recesses or stampings are made at an angle of 45° relative to the longitudinal direction of the profile, whereby a recess 15 will correspond to the cross-section of the post 1, 1*a*. In the embodiment shown the profile 3, 4 has a centrally located recess 15, the cross section of which corresponds to the cross section of an entire post, whereas the profile at each of its two ends is provided with a half recess 15*a*, which corresponds to a half post. These base portions 3 are intended to act as bases for the posts and the posts are placed in upright position in the chute which is formed by the bottom and walls 12 of the base portion in said recesses 15, 15*a*, whereupon the base portions and the posts are interconnected preferably by means of self-tapping screws. The head portions 4 which are identically similar to the base portions are located in corresponding manner on top of the posts and they are connected thereto in the same manner. By means of this connection the posts and the base portions/head portions will form a continuous framework after mounting.

Figure 9:
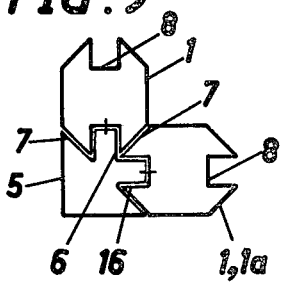
FIG. 9 is a schematic view from above of a corner connection incorporating two posts and corner profiles interconnecting said posts.
Figure 10:
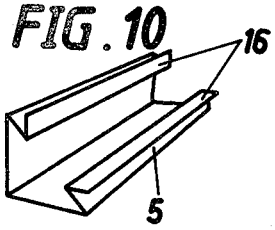
FIGS. 10 and 11 are perspective views showing a corner profile according to FIG. 9.
Figure 11:
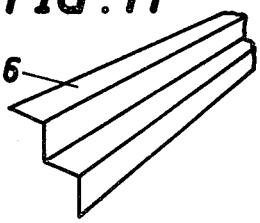

In order to form a corner in the structur two posts 1 are as shown from above in FIG. 9 placed side by side with their grooves 8 turned perpendiculary to each other and with two inclined post surfaces 7 contacting each other. An interconnecting corner profile 6—see FIG. 11—is fitted e.g. by means of self-tapping screws to the two adjacent posts, whereby also these will be connected. The corner is therupon finished thereby that a corner profile 5—see FIG. 10—is fitted to the posts. This corner profile 5 has a cross section corresponding to an isosceles right angle triangle, in which the hypotenuse is broken and formed with two lugs 16, which extend out from the triangle in parallel with the adjacent smaller side of the triangle. The corner profile 5, which is made from sheet metal is connected to the post by being pushed from the outside inward against the posts, whereby its lugs 16 during bending will slide on the inclined surfaces 7 of the posts and will snap into the grooves 8, whereby they will flex back and be locked in their position. At this mounting of a corner it is possible with a finebladed tool to enter between the inclined surface 7 of the post and the part of the corner profile 5 cooperating therewith and therby to press the lug 16 from its engagement with the edge of the groove 8.

Figure 12:
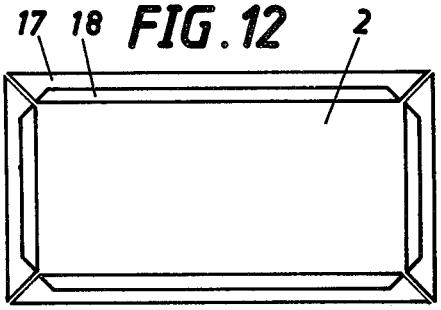
FIG. 12 is a plan view of a panel section forming part of the structure.

In FIG. 12 is shown in a plan view a panel section 2 from the side turned inwards during mounting. The opposite side is as can be seen from FIG. 1 preferably entirely smooth. The panels can however also be provided with reinforcing bendings or the like without this being critical for the invention. The panel section 2 is along its inner edges bent in a first flange 17 at an angle of 45° and a second bent flange 18 is provided at the outer end of said first flange, which second flange is likewise bent 45° and in a direction outwards. These flanges corresond to the lugs at the corner profile 5 and they are used in a corresponding manner for locking the panel sections to the base portions, to the posts and to the head portions.

Figure 13:
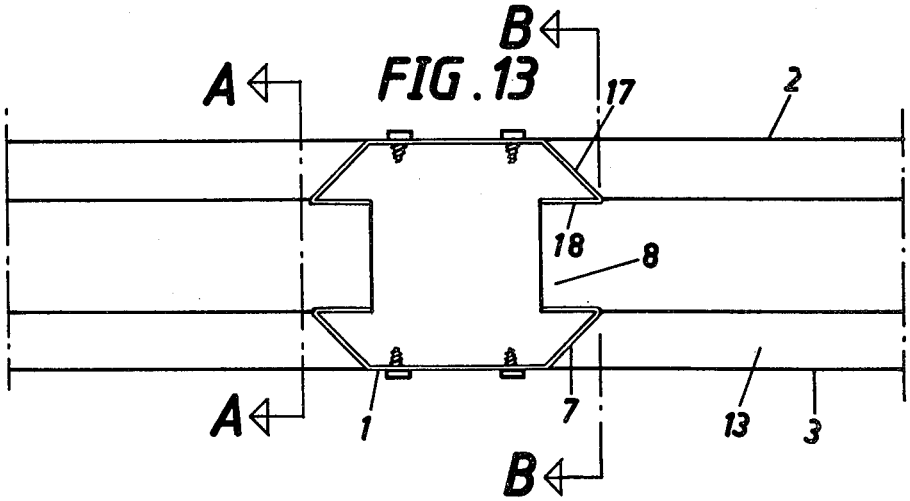
FIG. 13 is a schematic view from above of a base portion and a post fitted thereto in its mounting position.

In FIG. 13 is shown in a view from above a part of a base portion 3 with a post 1 fitted and screwed thereto and this view shows how the post 1 with its inclined surfaces 7 will be guided by the inclined recesses 15 in the base portion. In this FIGURE is also shown a panel section 2, which with one of its edge flanges rests against and which has been snapped to the bent parts 13 of a base portion and to its flange portion 14, respectively, whereas the adjacent edge flanges 17, 18 have been snapped into the groove 8 and rest against the inclined surface 7 of the post.

Figure 14:
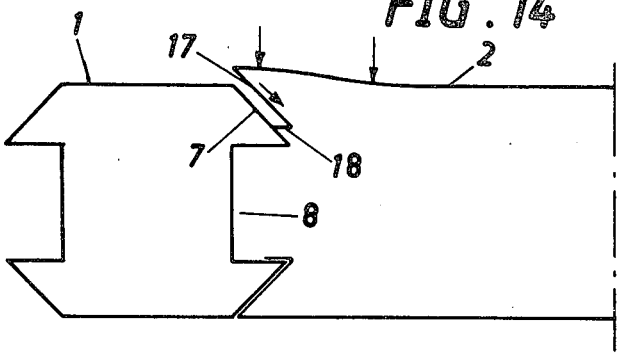
FIG. 14 is a view corresponding to FIG. 13, wherein for the sake of clarity the base portion has been omitted and in which a panel section has been mounted, whereas the other section is shown in its mounting stage.

In FIG. 14 is shown the snapping-in of a panel section 2 to a post 1 in which for the sake of clarity the base portion has not been shown and the panel section 2 is hereby subjected to a manual force directed inwards, whereby all flange portions 17 and 18 simultaneously or one after the other will be brought to flex out and slide against the inclined surface 7 of the post and against the inclined portions 13 of the base portion and the head portion respectively until the second bent flange 18 will be in position to snap into the groove 8 and behind the flange portions 14 of the base portion and the head portion respectively.

Figure 15:
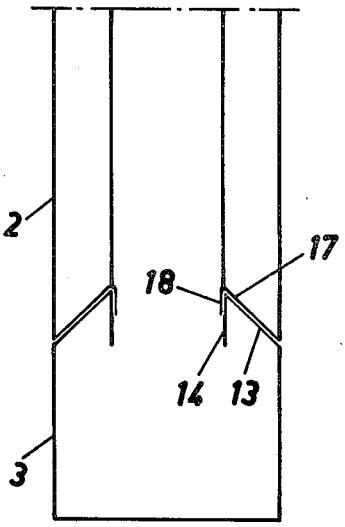
FIGS. 15 and 16 are croos-sectional views through the member shown in FIG. 13 taken along lines A—A and B—B, respectively.
Figure 16:
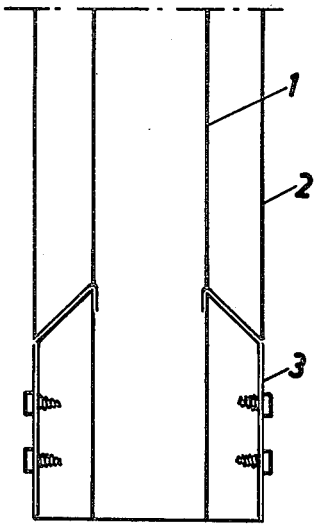

In FIGS. 15 and 16 there are shown two cross-sections along lines A—A and B—B in FIG. 14 respectively which illustrate the cooperation of the panel sections 2 with the base portion 3, which cooperation functionally is analogus with the cooperation with the post.

Figure 17:
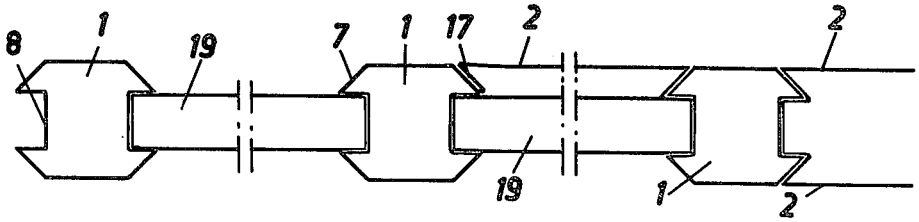
FIG. 17 is a schematic view from above of three posts with different combinations of wall sections fitted thereto.

FIG. 17 finally shows in a schematic view from above the possibility of the building structure according to the invention to use different types of wall sections which can be utilized for further increasing the flexibility and adaptability of the structure.

In this figure is shown as an example three spaced apart posts 1 placed in a line. To the right hand side of a post shown farthest to the right is fitted two panel sections 2, which are fitted by snapping-in in the same manner as shown in e.g. figure 13. Between the left and the central post there is however fitted a smooth flat wall element 19, which with its edges engages in and is retained in the grooves 8 between the shanks of the H-profile of the posts (and also in the grooves in the not shown base portions and head portions). In the space between the central and the right hand post is finally shown how it is possible to combine a snapped-in panel section 2 and a wall element 19.

The wall element 19 can be of different types and it is e.g. possible to use wall-paper provided particle boards, plaster boards or the like, window units in frames etc., whereby the inclined surfaces of the posts, the base portions and the head portions can be coloured in a suitable tint and can then act as surrounding borders. As it is possible also to make the wall sections with different material at opposite sides it is e.g. possible to have a board wall at one side made with plane wall elements and on the opposite side an "outer wall" of panel sections, which have been snapped to the framework.

In the case of wall elements 19 fitted in the grooves it is of course necessary to mount the wall elements in a manner which differs from that of the snappable wall panels, i.e. it is necessary to place the wall element 19 in the framework before this is completed, whereby the wall can be completed and locked by means of one of the posts, which hereby is put in place by being moved in the longitudinal direction of the wall element. The mounting is however also in this case comparatively simple and so is also a possible later dismounting.

With this mounting technique it is possible to erect buildings of this type very swiftly and also to dismount them as it is hereby sufficient to unscrew the screws retaining the head portion and the base portion and to pull out these parts in the longitudinal direction from the remaining structure, whereupon the further components—the wall elements, the panel sections and the posts—can be easily taken apart. With this building structure it is possible either to standardize the elements forming part thereof to a very high degree or to adapt the portions to the actual need, e.g. by changing the width of the sections, varying the height of the base portions or the head portions, designing the sections as holders for lamp fittings, armatures, exhaust suction filters etc, which means that the structure will have a very high flexibility. It is also possible to provide the building with doors made in a corresponding manner and to arrange insulating material in the post and/or between the panel sections. It is also possible to design the panel section of another material than sheet metal, e.g. in wood with flexible attachment flanges fitted thereto or to make the entire structure or parts thereof in another material which is equivalent from a material point of view, e.g. some plastic types.

The invention is not limited to the embodiments shown in the drawings and described in connection thereto but modifications are possible within the scope of the appended claims.

We claim:

1. A building structure incorporating a framework of vertical posts, interconnected by base members and head members and with separate wall panels fitted in the spaces between the posts, base members and head-members, comprising each post has an approximately H-shaped cross-section having legs and a web between the legs forming oppositely disposed grooves, the outer face of each leg is inclined inwardly, each base member and head member is provided with a groove facing towards the center of the framework, the grooves between the legs of the posts facing toward said center, the outer faces of the portions of the base and head members adjacent the grooves are inclined to extend parallel to said inclined faces of said posts, and said wall panels are thin walled panel sections having inturned flanges along all edges inclined to correspond with the respective inclined surfaces of the posts, base members and head members, said flanges at their outer edges being provided with folded back lip portions which engage with a snap-fit in the grooves of the respective posts, base members and head members.

2. A building structure as claimed in claim 1 wherein, said base members and head members are channel sections having portion of the sides adjacent the opening folded inwardly, and cut-outs are provided in said folded side portions shaped to receive the respective ends of a post.

3. A building structure as claimed in claim 2 wherein each post is connected to the respective base member and head member by separate attaching means.

4. A building structure as claimed in claim 2 wherein said posts are constructed from three pairs of sheet metal sections having folded flanges, each section of one of the pairs of sections having a channel shaped cross-section with angled sides which form said inclined surfaces of said post and inturned flanges at the outer edges of said sides which engage over the flanges of the other pairs to interconnect the other two pairs of sections.

5. A building structure as claimed in claim 1 wherein, said inclined surfaces of said posts, base members, head members and flanges of the panel sections all extend at an angle of 45° with respect to the plane of the framework.

6. A building structure as claimed in claim 5 and further comprising a corner connection for joining two posts arranged perpendicularly to each other, said corner connection comprising a sheet metal section folded into accordion pleats for fitting into the adjacent grooves of said posts, separate attachment means for attaching said pleated section in said grooves, and a cover member in the form of a right-angle section having flanges folded inwardly at 45° and outwardly folded lips on the edges extending at 45° to these flanges and which snap-fit into said adjacent grooves of the posts.

* * * * *